United States Patent [19]

Dutta et al.

[11] 4,191,149

[45] Mar. 4, 1980

[54] CARBURETORS FOR INTERNAL COMBUSTION ENGINES

[75] Inventors: Rathindra Dutta, Kaarst; Josef Rosgen, Grevenbroich; Gerd Rosemann, Munchen-Gladbach, all of Fed. Rep. of Germany

[73] Assignee: Societe Industrielle de Brevets et d'Etudes S.I.B.E., Neuilly sur Seine, France

[21] Appl. No.: 861,358

[22] Filed: Dec. 16, 1977

[30] Foreign Application Priority Data

Jan. 14, 1977 [FR] France ..... 77 01078

[51] Int. Cl.[2] ..... F02M 7/00; F02M 7/06

[52] U.S. Cl. ..... 123/119 EC; 123/139 AV; 261/DIG. 67; 60/285

[58] Field of Search ..... 123/139 AV, 119 EC; 60/276, 285; 261/DIG. 67

[56] References Cited

U.S. PATENT DOCUMENTS

| | | | |
|---|---|---|---|
| 4,007,719 | 2/1977 | Brettschneider et al. | 60/285 |
| 4,034,730 | 7/1977 | Ayres et al. | 123/139 AV |
| 4,039,638 | 8/1977 | Hill | 261/DIG. 67 |
| 4,089,311 | 5/1978 | Brettschneider et al. | 261/DIG. 67 |

FOREIGN PATENT DOCUMENTS

| | | | |
|---|---|---|---|
| 2219880 | 10/1973 | Fed. Rep. of Germany | 261/DIG. 67 |
| 2239371 | 2/1974 | Fed. Rep. of Germany | 261/DIG. 67 |

*Primary Examiner*—Charles J. Myhre
*Assistant Examiner*—R. A. Nelli
*Attorney, Agent, or Firm*—Stevens, Davis, Miller & Mosher

[57] ABSTRACT

A carburetor has a float chamber and a device for adjusting the gaseous pressure in the float chamber. The device comprises a pressure source and a probe contacting the exhaust gas and delivering a signal which is a function of the exhaust gas composition. The device has an airflow pipe connecting the source to atmosphere, a throttle for impressing a head loss to the flow and controlled by the probe and a venturi located in the pipe and connected to the float chamber for giving a pressure which may be out of the range between the source pressure and atmospheric pressure.

7 Claims, 6 Drawing Figures

Fig.3.
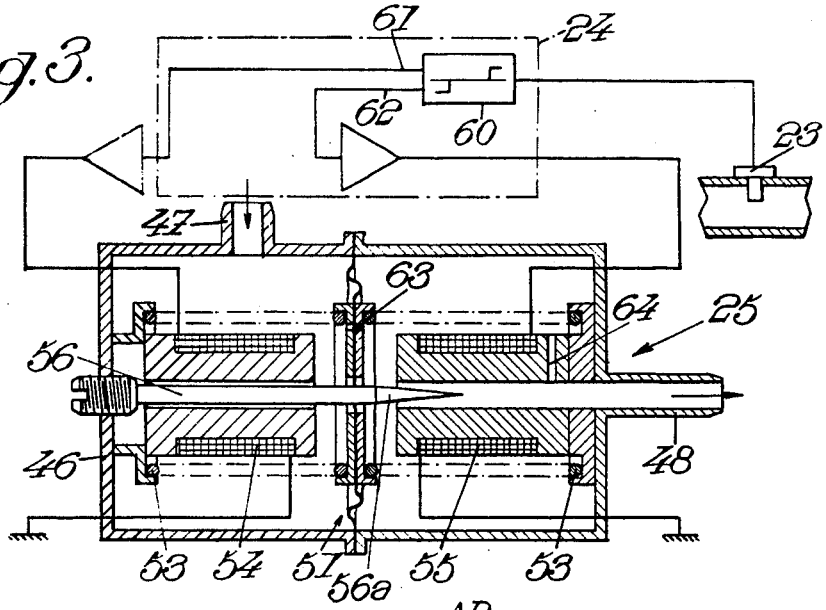
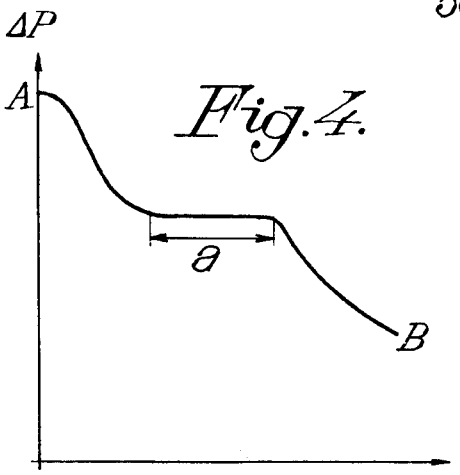
Fig.4.
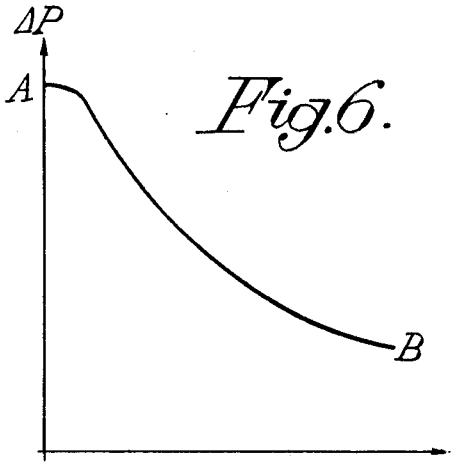
Fig.6.
Fig.5.
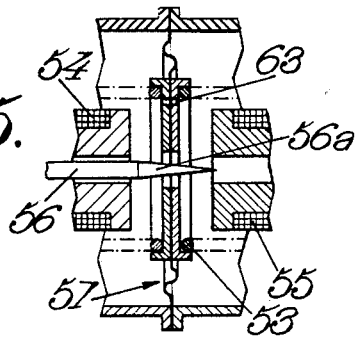

CARBURETORS FOR INTERNAL COMBUSTION ENGINES

BACKGROUND AND SUMMARY OF THE INVENTION

The invention relates to carburetors for internal combustion engines in which the richness of the air-fuel mixture supplied to the engine is adjusted responsive to the composition of the engine exhaust gases.

The invention relates more particularly to carburetors for internal combustion engine comprising a float chamber and a device for adjusting the pressure in the tank to a value in dependence on the composition of the engine exhaust gases, the device comprising a source of pressure different from atmospheric pressure and a probe immersed in the exhaust gases and supplying a signal depending on the composition thereof.

In a prior art device of that type (U.S. Pat. No. 3,730,157) the pressure source is either a region at a pressure below atmospheric pressure or a pump supplying compressed air.

That prior art device can bring the pressure of the float chamber either to a value between atmospheric pressure and a subatmospheric pressure (which tends to reduce the amount of fuel admitted into the carburetor inlet pipe and consequently to reduce the richness of the air-fuel mixture supplied to the engine) or to a pressure between atmospheric pressure and the pressure supplied by the compressed air source. However, a single device cannot supply pressures above and below atmospheric pressure.

It is an object of the invention to provide a carburetor wherein the pressure may be adjusted with a wider range than in prior art carburetor, while it includes a single source of air at a pressure different from atmospheric pressure.

According to the invention, there is provided, inter alia, a carburetor for internal combustion engine, comprising a float chamber and a device for adjusting the gas pressure in the float chamber, said device having: a source of air at a pressure different from atmospheric pressure; airflow passage means connecting said source and atmosphere means on said airflow passage means for impressing a head loss to the airflow; an oxygen sensitive probe adapted to be immersed in the exhaust gas of the engine and to provide an electrical signal representative of the oxygen content of said exhaust gases; control means for actuating said throttle means responsive to said electrical signal; and means connected to the float chamber, located in the airflow passage means and so constructed that it conveys to the float chamber a pressure whose value is outside the range between the pressure of the source and atmospheric pressure for a predetermined range of values of said head loss.

The source can be at a pressure above atmospheric pressure and then the last-mentioned means typically comprises a construction, which may be the throat of a venturi.

Alternately, the source can be at a pressure below atmospheric pressure, for instance the vacuum downstream of the operator actuable throttle member of a carburetor; then the last named means can comprise a Pitot tube.

The head loss means may be a valve actuated in dependence on the signal supplied by the probe for adjusting the flow rate of air through the pipe.

The invention will be better understood from the following description of carburetors constituting non-limitative embodiments thereof.

SHORT DESCRIPTION OF DRAWINGS

FIG. 1 is a schematic view of a carburetor wherein the pressure in the float chamber is adjusted by a device comprising a compressor and a venturi;

FIG. 2, which is similar to FIG. 1, shows a modified embodiment wherein the pressure source is that portion induction passage which is downstream of the operator operable throttle means;

FIG. 3 is a block diagram of a valve suitable for use in the carburetor in FIGS. 1 and 2;

FIG. 4 shows the variation in the pressure drop produced by the valve in FIG. 3, plotted vs the travel of its moving part;

FIG. 5 is a partial view of a modified embodiment of the valve in FIG. 3; and FIG. 6, similar to FIG. 4, shows the pressure drop variation in the case of the valve in FIG. 5.

DESCRIPTION OF PREFERRED EMBODIMENT

Figure 1:
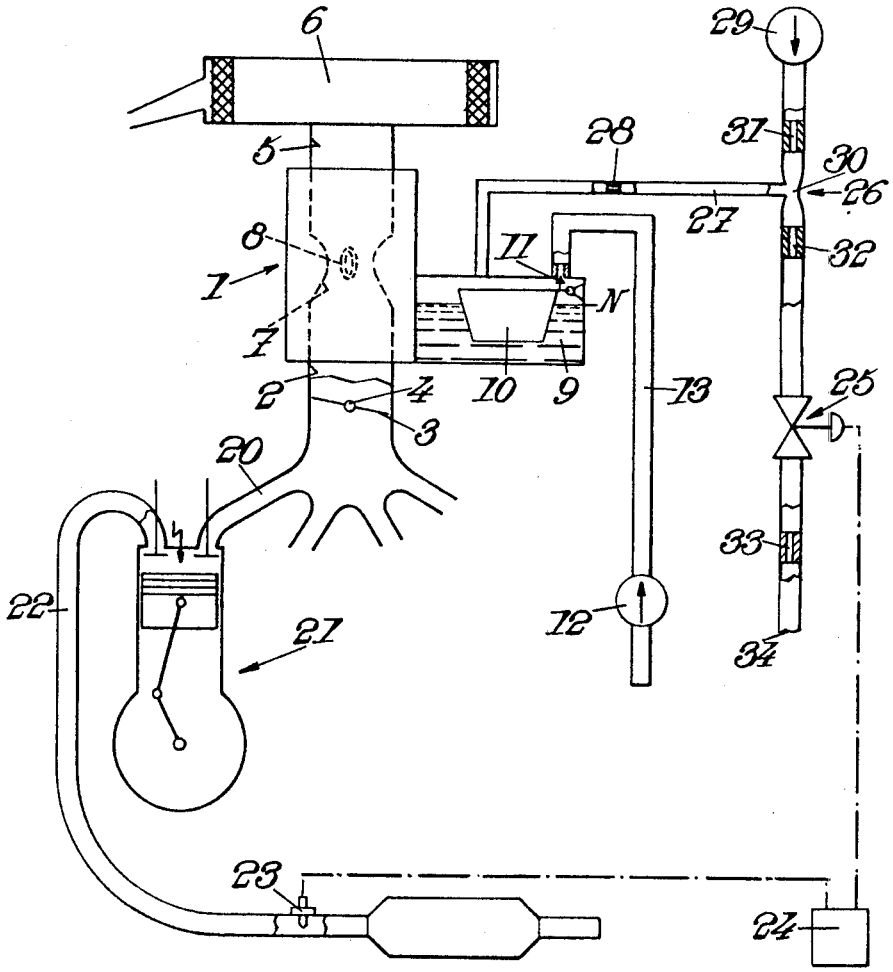
Figure 2:
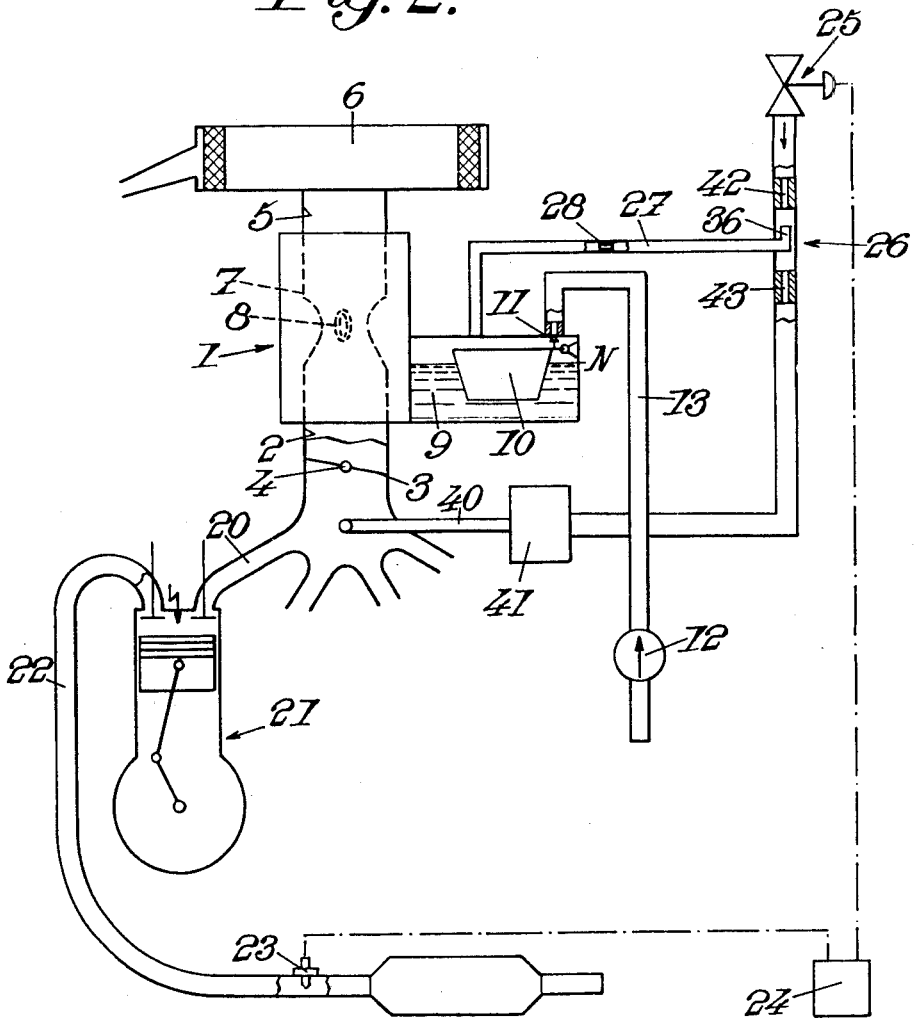

Referring to FIGS. 1 and 2, there is shown a downdraught carburetor comprising an induction passage 2 provided with operator operable throttle means 3, illustrated as a butterfly valve secured to an operator actuated shaft 4. Passage 2 has an air inlet 5 protected by an air filter 6 and a main venturi 7 into which a main fuel jetting system 8 delivers an air-fuel emulsion. System 8 is supplied with fuel by a float chamber 9. Chamber 9 contains a float 10 actuating a float needle 11 admitting fuel so as to maintain the free surface of fuel permanently at a level N. Chamber 9 is supplied with fuel from a tank (not shown) by a pump 12 delivering fuel to a pipe system 13 whose outlet is controlled by the float needle 11.

Carburetor 1 supplies the intake manifold 20 of an engine comprising a number of cylinders such as 21 connected to an exhaust manifold 22.

A suitable measuring probe 23 disposed in exhaust manifold 22 supplies an electric signal which is representative of the composition of the engine exhaust gases. The signal is sent to electric computing means 24 which actuates head loss means (i.e. valve 25) for metering the flow rate of air in a pipe 26. An intermediate point of pipe 26 is connected to the upper portion of the float chamber by a line 27 provided with a calibrated orifice 28.

The computing means 24 is designed to adjust the flow cross sectional area defined by valve 25 so as to maintain the signal supplied by probe 23 at a predetermined value. Means 24 can be of a simple analog computer of conventional design and need not be described here.

In the embodiment of the invention shown in FIG. 1, pipe 26 is supplied with air by a compressor 29 and its outlet is connected to atmosphere through an orifice 34. There are found in series relation along pipe 26: a first calibrated orifice 31; a venturi 30 having a throat into which line 27 opens; a second calibrated orifice 32; valve 25; and a third calibrated orifice 33.

The pressure regulating device operates as follows. When the compressor is in operation, the pressure difference between the compressor outlet and orifice 34 at atmospheric pressure is distributed between the pressure drops occurring at orifices 31, 32, 33 and at valve 25. If the flow cross sectional area left free by valve 25 is small as compared with those of the calibrated orifices 31, 32, 33, the greater part of the overall head drop occurs at valve 25 and the pressure immediately downstream of orifice 31 will be close to the outlet pressure of compressor 29. The flow rate of air pipe 26 will be low, and consequently the pressure drop at the venturi throat will likewise be low. As a result, line 27 will maintain the atmosphere of the float chamber 9 at a pressure considerably above atmospheric pressure, resulting in a higher flow rate of fuel and consequently in increased richness of the air-fuel mixture supplied via the inlet manifold to the engine.

If, on the other hand, the flow cross-sectional area left free by valve 25 becomes considerably greater than those of orifices 32, 33 and particularly 31, the flow rate of air in pipe 26 increases. The pressure at the throat of venturi 30 decreases and may fall below atmospheric pressure if the venturi, the calibrated orifices and the valve are properly dimensioned. The resulting depression is transmitted by line 27 to the atmosphere of float chamber 9, reduces the amount of fuel supplied through the main jetting orifice 8, and decreases the richness of the air-fuel mixture supplied to the engine.

As can be seen, probe 23 controls valve 25 in dependence on the composition of the engine exhaust gases so as to control the richness of the air-fuel mixture supplied by the engine over a wide range, extending from an above-atmospheric pressure in chamber 9 to a pressure below atmospheric pressure.

In the modified embodiment shown in FIG. 2, pipe 26 connects a region at atmospheric pressure to that region of the induction passage disposed downstream of throttle means 3. The following components are disposed from upstream to downstream along the air path of air: a valve 25, a first calibrated orifice 42, a Pitot tube 36, a second calibrated orifice 43 and an oscillation dampening chamber 41. The end portion 40 of pipe 26 (between chamber 41 and the induction passage 2) has a smaller cross-section than the balance of pipe 26 in the embodiment shown.

The inner tube of the Pitot tube 36 is connected to the atmosphere of the float chamber 9 by an air line 27 provided with a calibrated orifice 28. That inner tube is disposed in the stream of air flowing in pipe 26, and is thus subjected to the dynamic pressure exerted by the air flowing through pipe 26.

Operation is similar to that previously described. When the air flow cross section through valve 25 is small as compared with the flow cross section of calibrated orifices 42 and 43, a considerable degree of vacuum (near that in the inlet manifold 20) prevails in the float chamber by line 27. As a result, the richness of the air-fuel mixture supplied to the carburetor inlet pipe is at a minimum.

If, on the other hand, valve 25 provides a wide flow cross-section for air coming from the outer atmosphere, air flows in pipe 26 at a considerable rate. The air exerts sufficient dynamic pressure on the inner tube of Pitot tube 26 to counterbalance the pressure drop at valve 25 and orifice 42 and beyond. The pressure transmitted to the float chamber by line 27 may reach a value above atmospheric pressure. The increased pressure results in a greater flow rate of fuel into the intake pipe 2, and consequently in a richer air-fuel mixture supplied to the engine.

Referring to FIG. 3, there is shown an embodiment of valve 25 and the associated control circuit which is responsive to the signal supplied by probe 23.

Valve 25 has a casing 46 formed with an air inlet 47 and an air outlet 48. A movable assembly 51, comprising a diaphragm clamped between two cup-shaped members, divides the inner chamber of casing 46 into an inlet compartment and an outlet compartment. The cup-shaped members are formed with a central aperture and co-operate with a needle 56 secured in the casing in an adjustable position and having a conical end portion **56*a*. The movable assembly is disposed between two electromagnets 54, 55 disposed opposite one another. Each electromagnet has a winding and an armature made of soft magnetic material. When both windings are de-energized, springs 53 hold assembly 51 in a center position between the two electromagnets. In the embodiment shown in FIG. 3, the cup-shaped members, are biassed at rest by springs 53 to a position where the central aperture is disposed around the cylindrical part of needle 56. Thus, if the movable assembly oscillates slightly around its rest position, there is no appreciable modification in the head loss coefficient $\Delta P$ (region a in FIG. 4**).

Referring to FIG. 3, the computer means 24 may be considered as binary rather than of the continuous-adjustment kind. It comprises a double threshold circuit 60 which receives the outlet signal from probe 23. When the outlet signal corresponds to an approximately stoichiometric composition, circuit 60 does not supply any outlet signal. When the signal supplied by probe 23 indicates a sub-stoichiometric composition whose air/fuel rates exceed a first threshold, output 61 of circuit 60 supplies a signal which is amplified and applied to the winding of electromagnet 54. Assembly 51 is attracted until the left hand cup-shaped member (made of magnetic material) contacts the stationary armature. The resulting head loss coefficient is represented by point A on FIG. 4. Since the head loss imposed by the valve is at a maximum, the pressure increases at the throat of the venturi 30 (in the embodiment shown in FIG. 1) and in chamber 9. The flow rate of fuel into the engine increases and tends to restore the stoichiometric composition. Conversely, if the composition becomes too super-stoichiometric, output 62 of the threshold element is energized and supplies electromagnet 55, so that the central aperture of the cup-shaped members co-operates with the conical part **56*a*, bringing the operation point to B (FIG. 4**). A depression is produced in the float chamber and reduces the flow rate of fuel to the engine.

Calibrated apertures 63, 64 are formed in the movable assembly and in the armature of electromagnet 55 and provide predetermined pressure drop when the valve is in either of the energized positions.

Of course, computer 23 may alternatively provide an analog rather than binary signal and supply the electromagnets with control currents, whose values depend on the difference between the fuel/air ratio of the mixture entering the engine and the stoichiometric ratio. In that case, integrating and/or differentiating elements can be added in increase stability.

In some cases it may be preferable to have a continuous curve of variation in the pressure drop vs. the travel of assembly 51. To this end, it is sufficient to position needle 56 so that its conical end part is opposite assembly 51 at rest as shown in FIG. 5. In that case, the head loss coefficient will vary in dependence on the travel of assembly 51 in the manner shown in FIG. 6.

We claim:

1. A carburetor for an internal combustion engine, comprising a float chamber and a device for controlling the gas pressure in the float chamber, said device having: an air source at a pressure below atmospheric pressure; airflow passage means connecting said source and atmosphere; throttle means on said air-flow passage means for impressing a head loss to the airflow; an oxygen sensitive probe adapted to be immersed in the exhaust gas of the engine and to provide an electrical signal representative of the oxygen content of said exhaust gases; control means for actuating said throttle means responsive to said electrical signal; and means connected to the float chamber, located in the airflow passage means and so constructed that it conveys to the float chamber a pressure whose value is outside the range between the pressure of the source and atmospheric pressure for a predetermined range of values of said head loss, said last-named means comprising a pitot tube, one end of which opens directly into the float chamber and the other end of which extends within and opens directly into the airflow passage means intermediate the ends thereof.

2. A carburetor according to claim 1, wherein the source of sub-atmospheric pressure is that region of the induction passage of the carburetor downstream of operator actuatable throttle means of said carburetor.

3. A carburetor according to claim 1, wherein the head loss means comprises a valve which is actuated in dependence on the signal supplied by the probe for adjusting the flow rate of air travelling along the airflow passage means.

4. A carburetor for an internal combustion engine, having an induction passage, an operator operable throttle means in said passage, a float chamber supplied with fuel and a device for controlling the gas pressure above the fuel level in the float chamber, said device comprising: a probe constructed and arranged to deliver an electrical signal representative of the oxygen content of the exhaust gases of the engine; airflow passage means connecting a source of air at substantially atmospheric pressure at one end thereof and a region of said induction passage located downstream of the operator actuatable throttle means at the other end thereof; a single valve in said airflow passage means for impressing a head loss to the airflow; electric control means for actuating said valve responsive to said electrical signal; and a pitot tube, one end of the pitot tube being directly connected to the float chamber and the other end thereof extending within and opening directly into the airflow passage means intermediate the ends thereof, said pitot tube and said valve being so proportioned that the pitot tube is able to convey to the float chamber a pressure which may exceed atmospheric pressure.

5. A carburetor according to claim 4, wherein said control means controls said valve for maintaining a substantially stoichiometric composition of the air/fuel mixture delivered to the engine.

6. A carburetor for an internal combustion engine, comprising a float chamber and a device for controlling the gas pressure in the float chamber, said device having: an air source which delivers at a pressure above atmospheric pressure; airflow passage means connecting said source and atmosphere; throttle means on said airflow passage means for impressing a head loss to the airflow; an oxygen sensitive probe adapted to be immersed in the exhaust gas of the engine and to provide an electrical signal representative of the oxygen content of said exhaust gases; control means for actuating said throttle means responsive to said electrical signal; and means connected to the float chamber, located in the airflow passage means and so constructed that it conveys to the float chamber a pressure whose value is outside the range between the pressure of the source and atmospheric pressure for a predetermined range of values of said head loss, said last-named means comprising a venturi in the airflow passage means intermediate the ends thereof and a second passage for control fluid, one end of the second passage opening directly into the float chamber and the other end thereof opening directly into the venturi.

7. A carburetor according to claim 6, wherein the head loss means comprises a valve which is actuated in dependence on the signal supplied by the probe for adjusting the flow rate of air travelling along the airflow passage means.

* * * * *